US008852059B1

(12) United States Patent
Stearns et al.

(10) Patent No.: US 8,852,059 B1
(45) **Date of Patent: *Oct. 7, 2014**

(54) ELLIPTICAL EXERCISE METHODS AND APPARATUS

(71) Applicants: Kenneth W. Stearns, Houston, TX (US); Joseph D. Maresh, West Linn, OR (US)

(72) Inventors: Kenneth W. Stearns, Houston, TX (US); Joseph D. Maresh, West Linn, OR (US)

( * ) Notice: Subject to any disclaimer, the term of this patent is extended or adjusted under 35 U.S.C. 154(b) by 117 days.

This patent is subject to a terminal disclaimer.

(21) Appl. No.: 13/625,661

(22) Filed: Sep. 24, 2012

(51) Int. Cl.
*A63B 22/00* (2006.01)

(52) U.S. Cl.
CPC ..... *A63B 22/001* (2013.01)
USPC ..... 482/52; 482/62

(58) Field of Classification Search
USPC ..... 482/51–52, 57, 62, 79–80
See application file for complete search history.

(56) References Cited

U.S. PATENT DOCUMENTS

| | | | | |
|---|---|---|---|---|
| 7,303,509 | B2 * | 12/2007 | Schroder | 482/52 |
| 7,455,623 | B2 * | 11/2008 | Wang | 482/52 |
| 7,513,854 | B1 * | 4/2009 | Stearns et al. | 482/52 |
| 7,608,019 | B1 * | 10/2009 | Stearns et al. | 482/52 |
| 7,682,288 | B1 * | 3/2010 | Stearns et al. | 482/51 |
| 8,272,995 | B2 * | 9/2012 | Stearns et al. | 482/52 |
| 2002/0155926 | A1 * | 10/2002 | Lat | 482/52 |
| 2003/0216222 | A1 * | 11/2003 | Kuo | 482/52 |
| 2005/0272562 | A1 * | 12/2005 | Alessandri et al. | 482/52 |
| 2006/0046902 | A1 * | 3/2006 | Chang | 482/52 |

* cited by examiner

*Primary Examiner* — Stephen Crow
(74) *Attorney, Agent, or Firm* — Nick A Nichols, Jr.

(57) ABSTRACT

Various exercise machines have foot supporting linkages that move a person's feet through respective left and right paths of motion in respective planes that are skewed relative to one another.

9 Claims, 18 Drawing Sheets

ELLIPTICAL EXERCISE METHODS AND APPARATUS

CROSS-REFERENCE TO RELATED APPLICATIONS

This is a continuation of U.S. patent application Ser. No. 12/419,203, filed Apr. 6, 2009, U.S. Pat. No. 8,272,995, which is a continuation of U.S. patent application Ser. No. 11/150,362, filed Jun. 10, 2005, U.S. Pat. No. 7,513,854, which in turn, claims priority to U.S. Provisional Application No. 60/578,766, filed on Jun. 10, 2004, all incorporated herein by reference.

FIELD OF THE INVENTION

The present invention relates to exercise methods and apparatus, and more specifically, to exercise machines that facilitate exercise movement through an elliptical path.

BACKGROUND OF THE INVENTION

A variety of exercise machines have been developed to generate elliptical foot motion. An object of the present invention is to modify such machines so that a user's feet are not constrained to travel in planes that are parallel to one another.

SUMMARY OF THE INVENTION

An aspect of the present invention is to facilitate movement of a person's left and right feet through respective, elliptical paths of motion that are not parallel to one another.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

An exercise machine constructed according to the principles of the present invention is designated as 100 in FIGS. 1-4. The machine 100 is similar in certain respects to exercise machines disclosed in U.S. Pat. No. 5,383,829 to Miller, which is incorporated herein by reference. However, whereas these prior art Miller machines generate left and right elliptical foot paths in adjacent left and right vertical planes, the machine 100 generates left and right foot elliptical foot paths in respective left and right planes that are skewed relative to the floor and one another.

Figure 1:
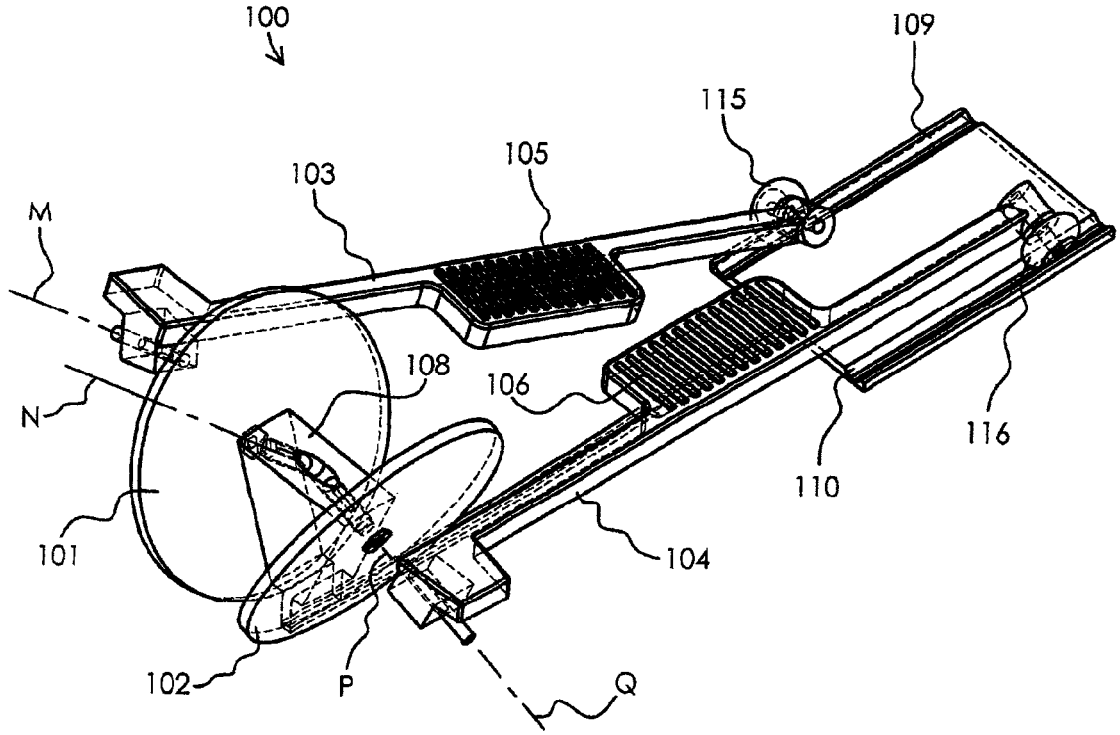
FIG. 1 is a perspective view of a first exercise machine constructed according to the principles of the present invention.
Figure 2:
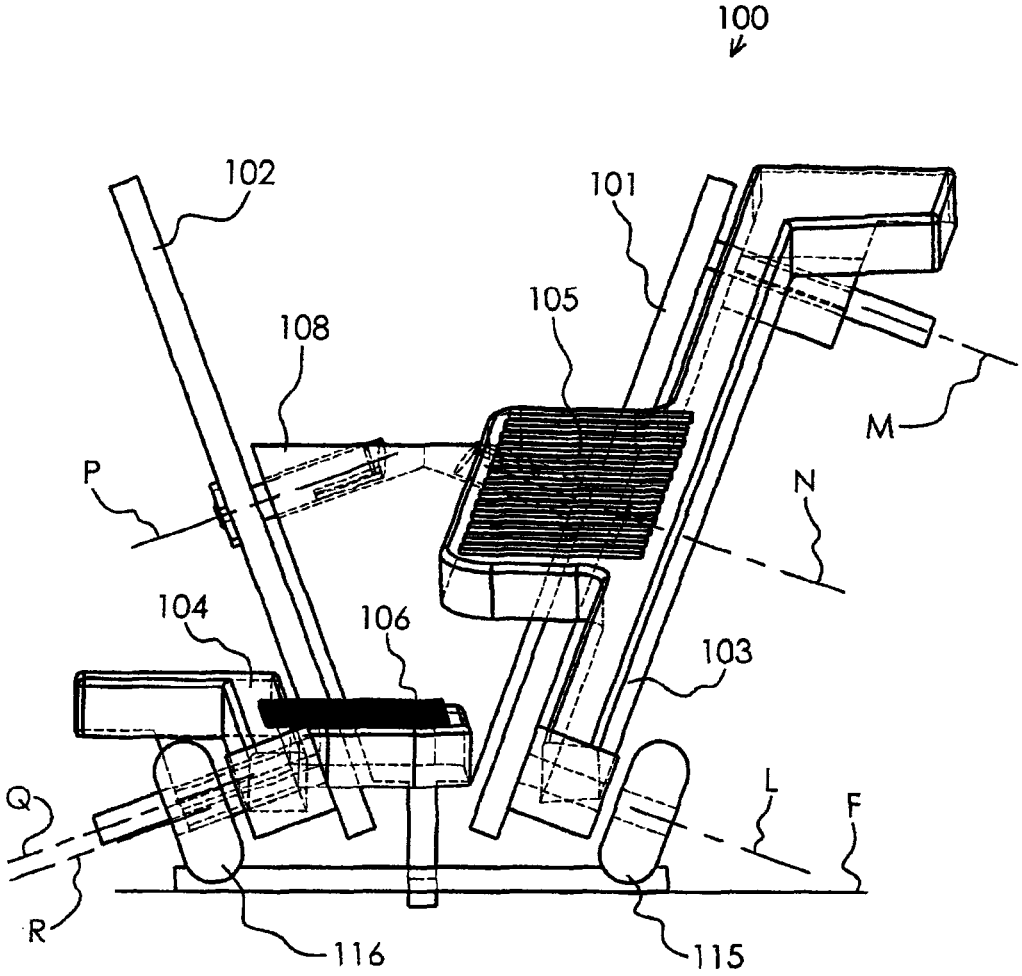
FIG. 2 is a front view of the exercise machine of FIG. 1.
Figure 3:
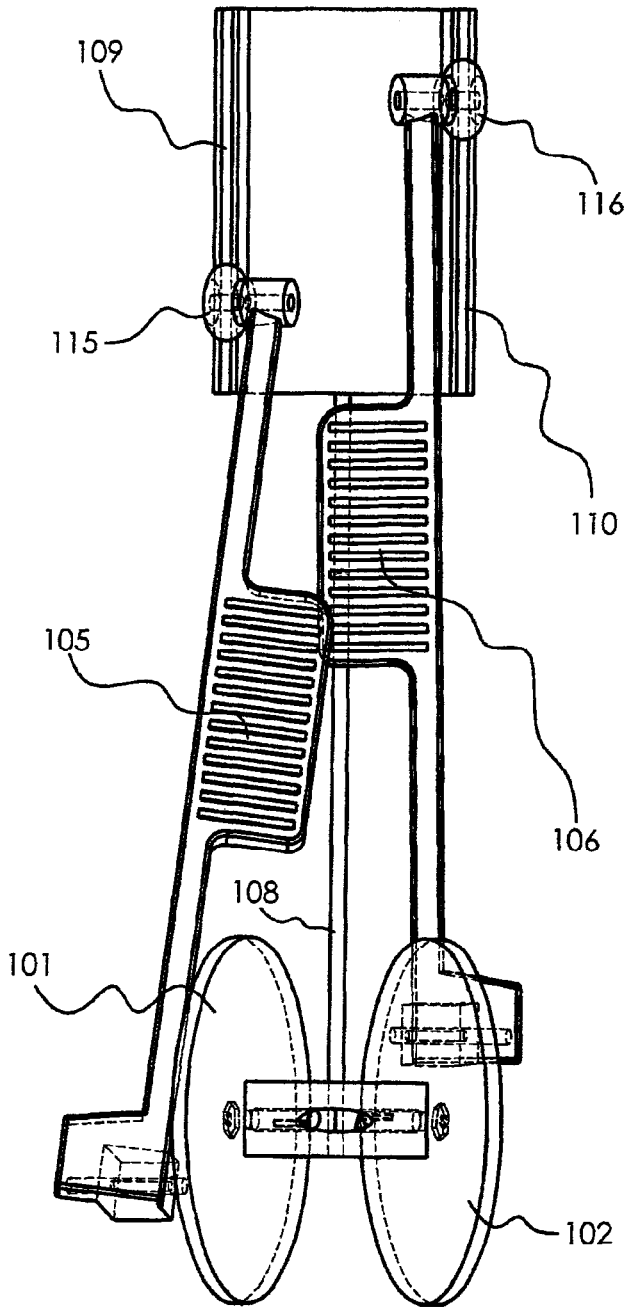
FIG. 3 is a top view of the exercise machine of FIG. 1.
Figure 4:
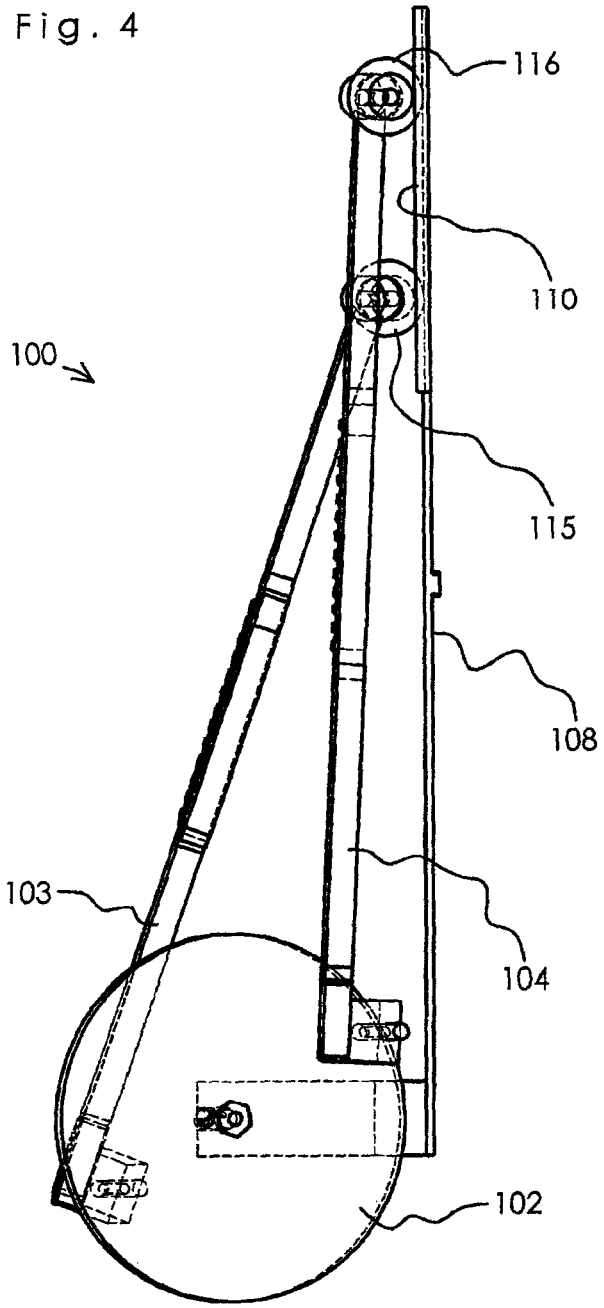
FIG. 4 is a side view of the exercise machine of FIG. 1.

The machine 100 includes a frame 108, and left and right cranks 101 and 102 rotatably mounted on the frame 108 for rotation about respective axes N and P. As shown in FIG. 2, each of the axes N and P extends away from the frame 108 in a manner that defines a respective angle of approximately 20 degrees relative to the underlying floor surface F. In other words, the axes N and P define an angle of approximately 140 degrees at their point of intersection.

Left and right foot links 103 and 104 have first ends that are rotatably connected to respective left and right cranks 101 and 102, thereby defining respective crank rod axes M and Q. The left crank rod axis M extends parallel to the left crank axis N, and the right crank rod axis Q extends parallel to the right crank axis P.

The foot links 103 and 104 have opposite, second ends that are rotatably connected to respective left and right rollers 115 and 116, thereby defining respective roller axes L and R. The left roller axis L extends parallel to axes M and N, and the right roller axis R extends parallel to axes P and Q. Each roller 115 and 116 is configured and arranged to roll in reciprocal fashion along a respective guide or race 109 or 110 on the frame 108.

Left and right foot platforms 105 and 106 are mounted on the intermediate portions of respective left and right foot links 103 and 104. The cranks 101 and 102 and the rollers 115 and 116 cooperate to move respective foot platforms 105 and 106 through generally elliptical paths of motion. The two foot paths occupy respective planes that are perpendicular to respective axes N and P (and that define an angle of forty degrees therebetween).

Assuming a person stands on the foot platforms 105 and 106 and faces away from the cranks 101 and 102, the user's feet move closer to the transverse center of the machine 100 during the leg power stroke, and conversely, the user's feet move further away from the transverse center of the machine 100 during the return stroke. This particular foot motion is the result of cranks 101 and 102 being angled toward the transverse center of the machine proximate the lower half of the crank swing or cycle.

The machine 100 is shown without any interconnection between the left foot supporting linkage and the right foot supporting linkage. However, those skilled in the art will recognize that the two linkages may be interconnected in a manner that maintains a desired phase relationship between the two linkages. For example, the two cranks 101 and 102 may be coupled by means known in the art (including a segment of steel cable, for example) to maintain the two crank rod joints (that define respective axes M and Q) in diametrical opposition to one another.

Figure 5:
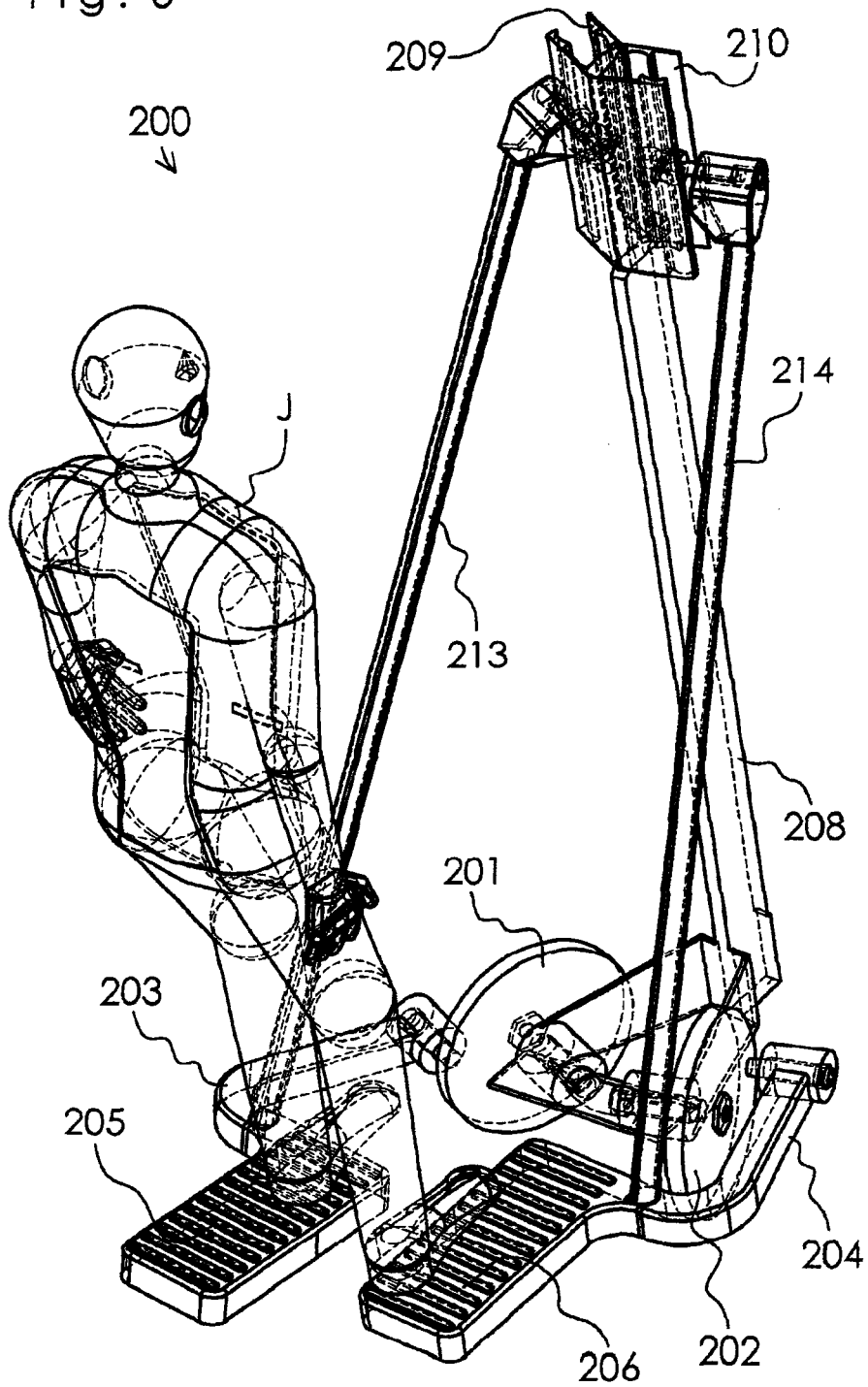
FIG. 5 is a perspective view of a second exercise machine constructed according to the principles of the present invention.
Figure 6:
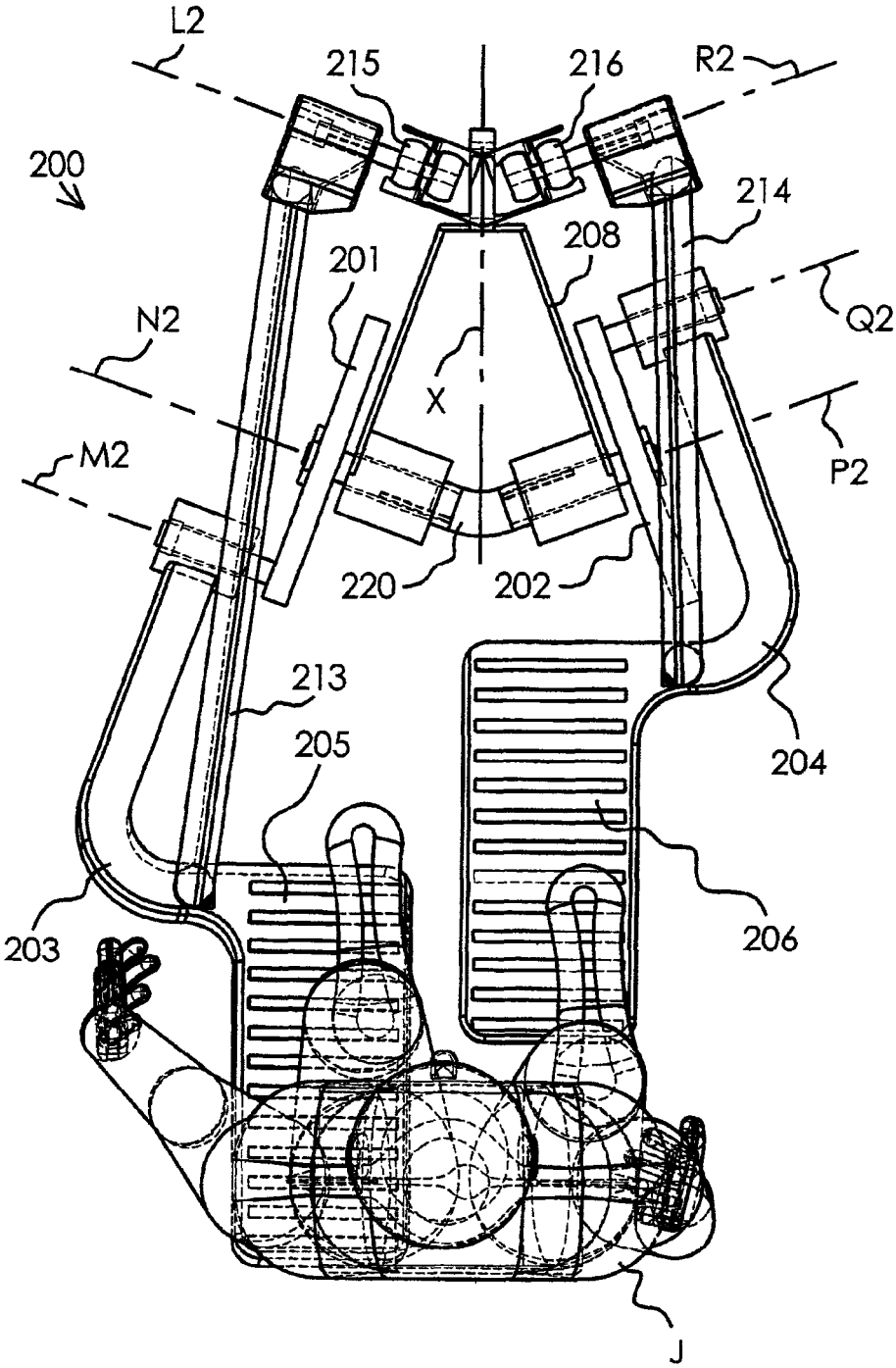
FIG. 6 is a top view of the exercise machine of FIG. 5.
Figure 7:
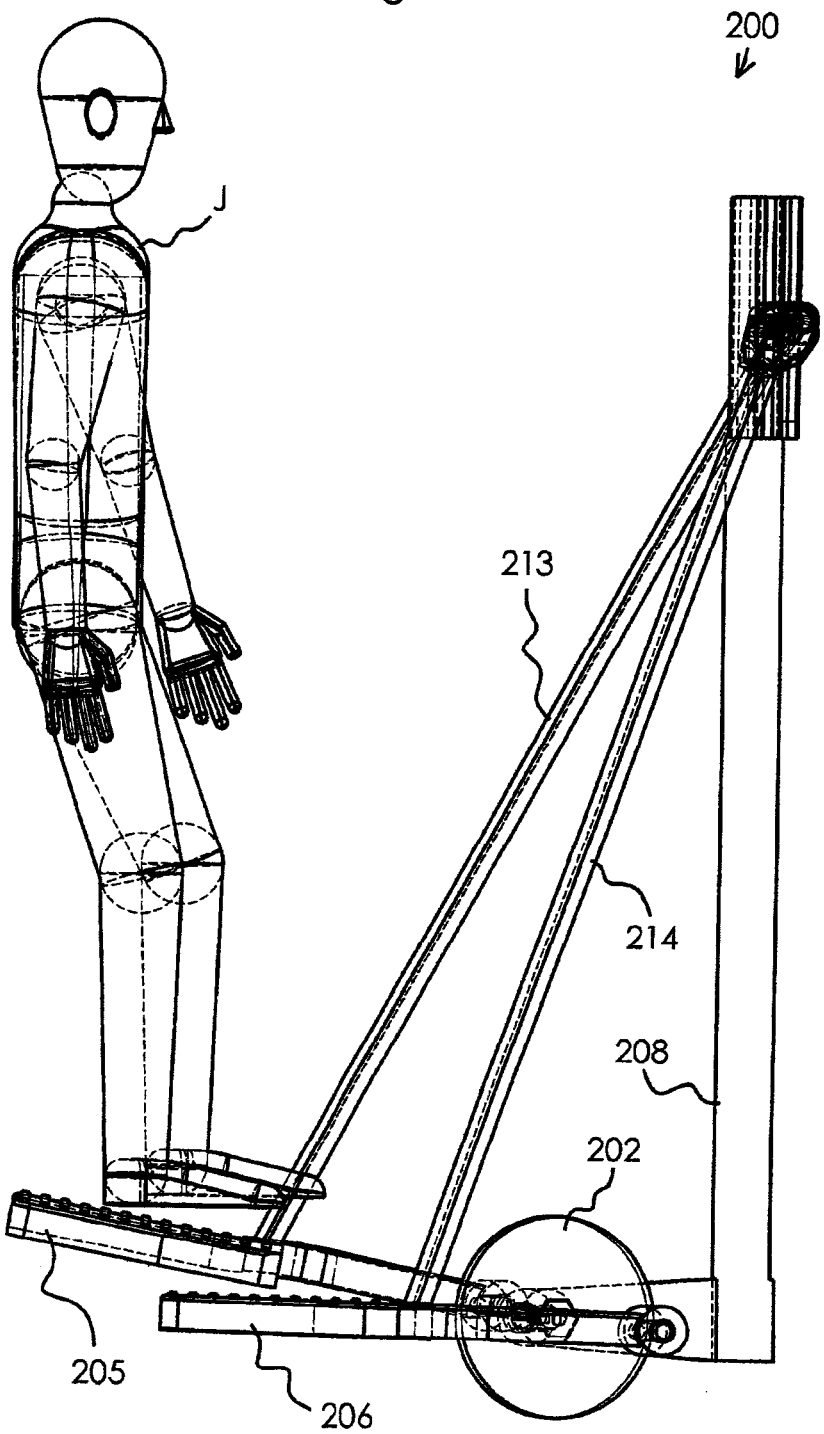
FIG. 7 is a side view of the exercise machine of FIG. 5.

Those skilled in the art will also recognize that the principles of the present invention may be implemented on other exercise machines, including other elliptical exercise machines. For example, FIGS. 5-7 show an exercise machine 200 constructed according to the principles of the present invention, and similar in certain respects to exercise machines disclosed in U.S. Pat. No. 6,135,923 to Stearns et al., which is incorporated herein by reference. However, whereas these prior art Stearns machines generate left and right elliptical foot paths in adjacent left and right vertical planes, the machine 200 generates left and right foot elliptical foot paths in respective left and right vertical planes that are skewed relative to one another.

The machine 200 includes a frame 208, and left and right cranks 201 and 202 rotatably mounted on the frame 208 for rotation about respective axes N2 and P2. As shown in FIG. 6, each of the axes N2 and P2 extends away from the frame 208 in a manner that defines a respective angle of approximately seventy degrees relative to a central longitudinal axis X that divides the machine 200 into similar (but out of phase) left and right halves. In other words, the axes N2 and P2 define an angle of approximately one hundred and forty degrees at their point of intersection.

Left and right foot links 203 and 204 have first ends that are rotatably connected to respective left and right cranks 201 and 202, thereby defining respective crank rod axes M2 and Q2. The left crank rod axis M2 extends parallel to the left crank axis N2, and the right crank rod axis Q2 extends parallel to the right crank axis P2.

The foot links 203 and 204 have intermediate portions that are rotatably connected to respective left and right roller pairs 215 and 216 (via respective rigid extension members 213 and 214), thereby defining respective roller axes L2 and R2. The left roller axis L2 extends parallel to axes M2 and N2, and the right roller axis R2 extends parallel to axes P2 and Q2. Each roller pair 215 and 216 is configured and arranged to roll in reciprocal fashion along a respective guide or race 209 or 210 on the frame 208.

Left and right foot platforms 205 and 206 are mounted on opposite, second ends of respective left and right foot links 203 and 204. The cranks 201 and 202 and the roller pairs 215 and 216 cooperate to move respective foot platforms 205 and 206 through generally elliptical paths of motion. The two foot paths occupy respective planes that are perpendicular to respective axes N2 and P2 (and that define an angle of forty degrees therebetween).

The machine 200 is shown with a torque coupler 220 interconnected between the left foot supporting linkage and the right foot supporting linkage. The torque coupler 220 operates in a manner known in the art to link rotation of the cranks 201 and 202 and maintain an approximately one hundred and eighty degree phase difference between the axes M2 and P2. In the alternative, the machine 200 may be constructed without any such coupler 220, in which case the two foot platforms 205 and 206 may be moved independent of one another.

Figure 8:
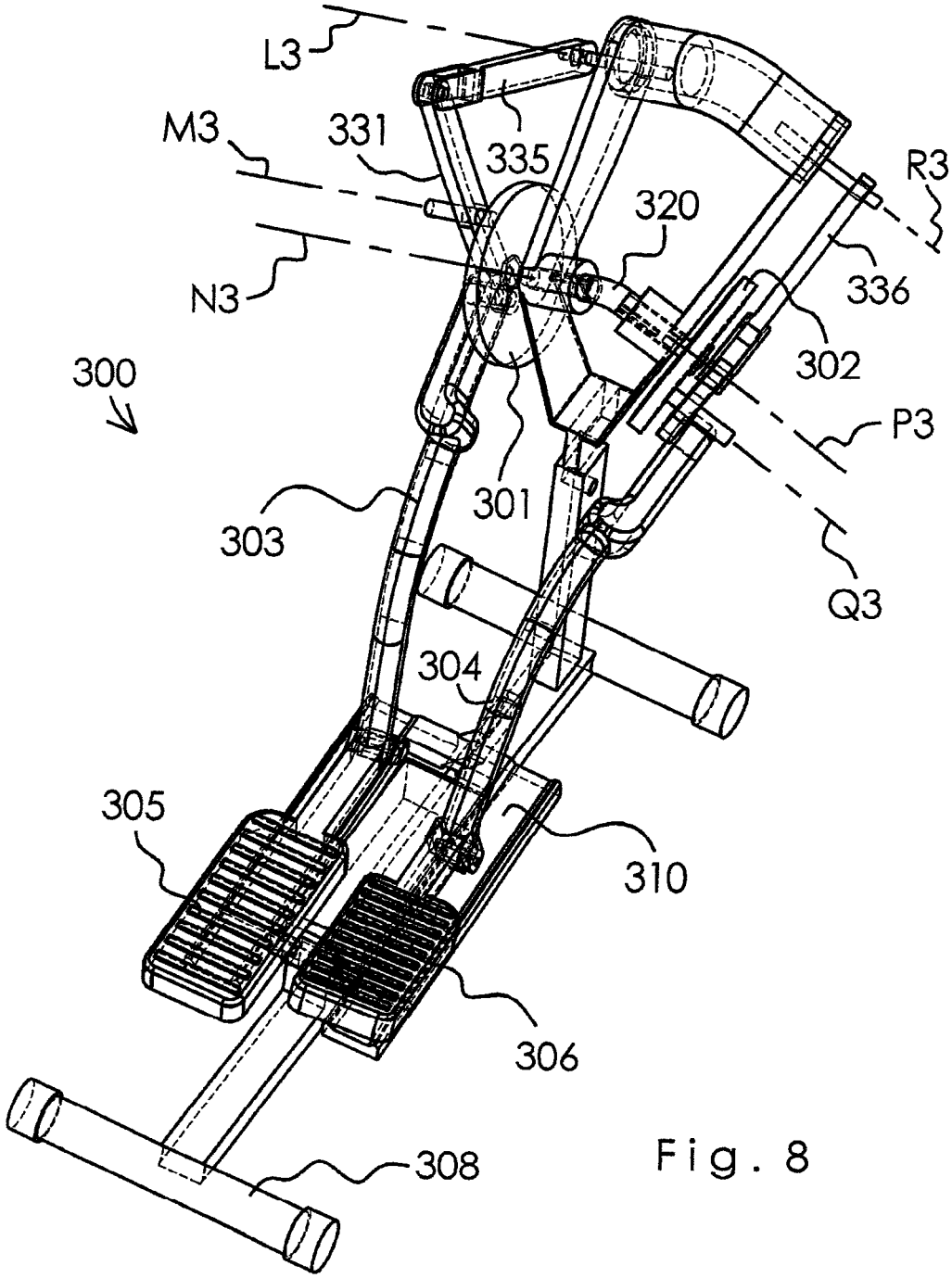
FIG. 8 is a perspective view of a third exercise machine constructed according to the principles of the present invention.
Figure 9:
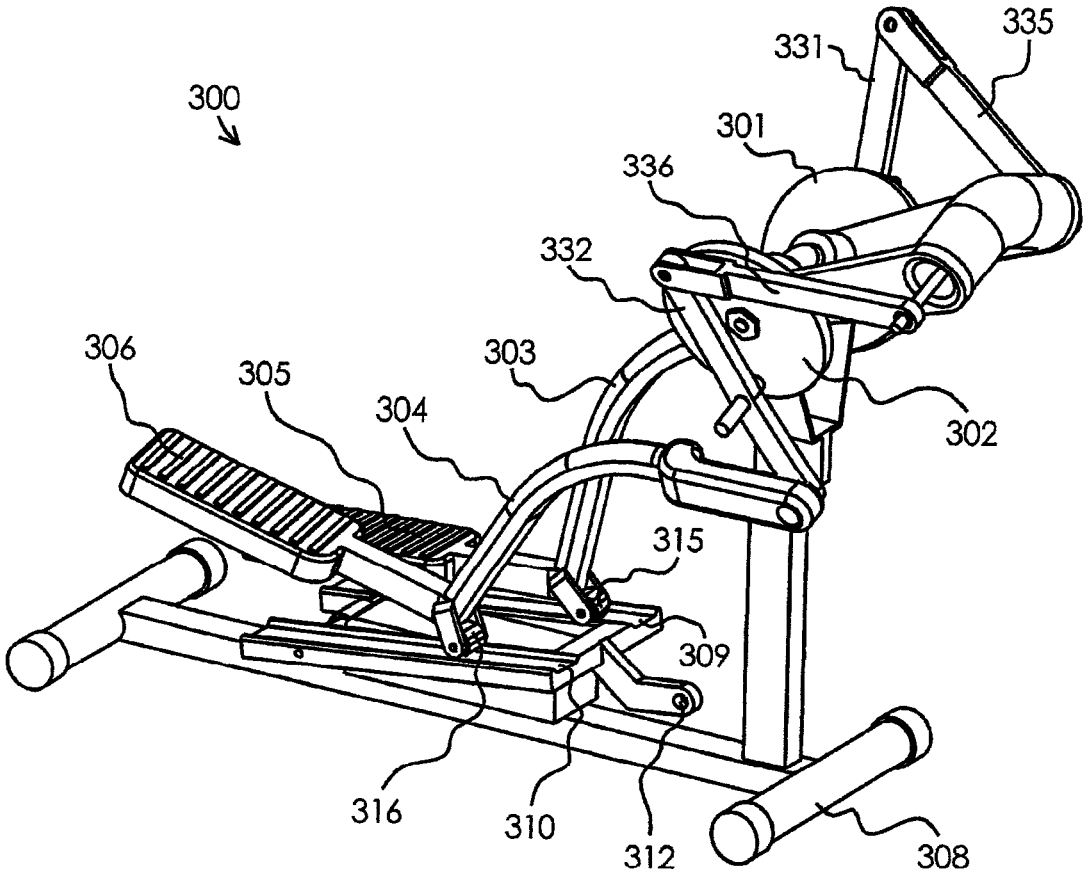
FIG. 9 is another perspective view of the exercise machine of FIG. 8.
Figure 10:
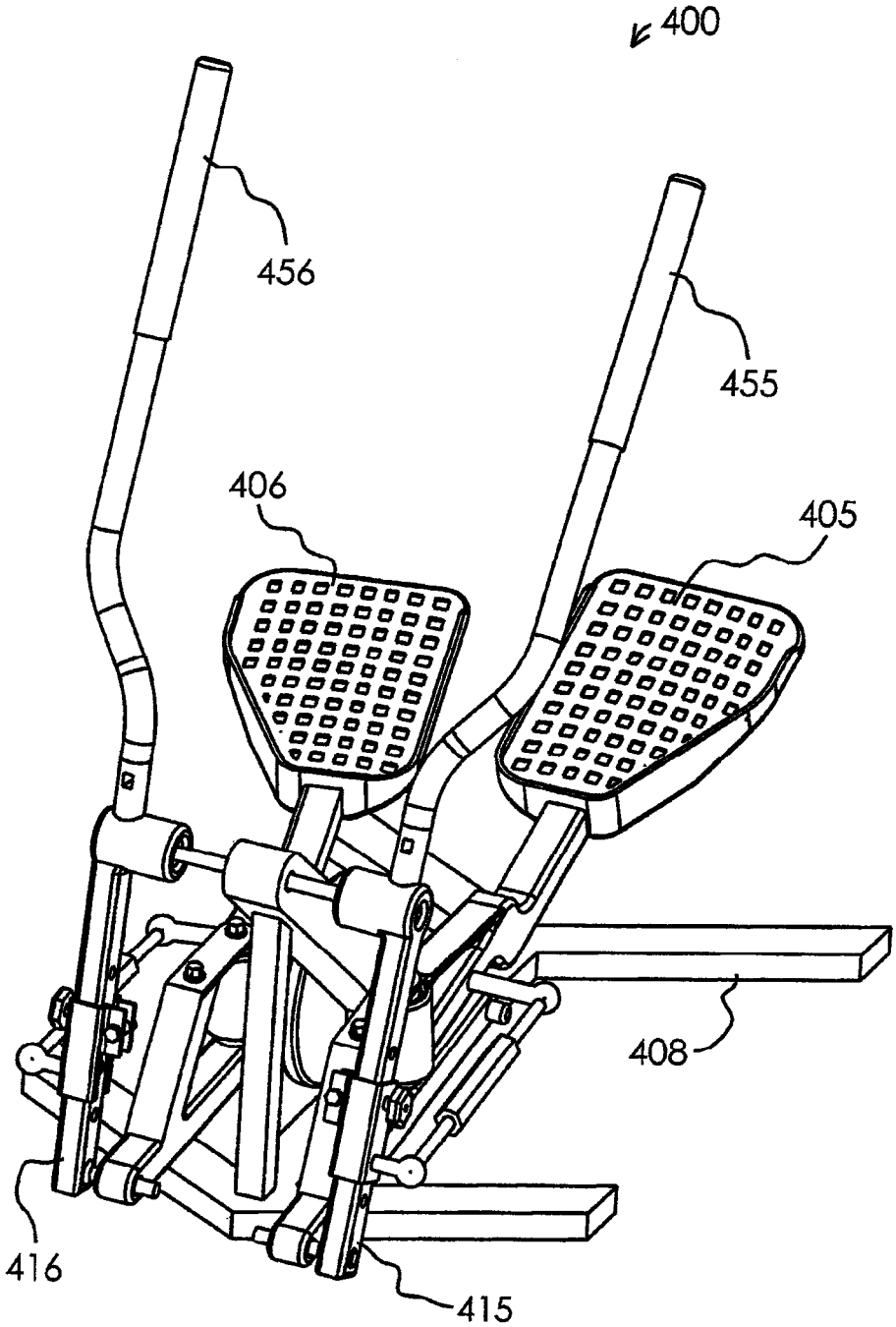
FIG. 10 is a perspective view of a fourth exercise machine constructed according to the principles of the present invention.
Figure 11:
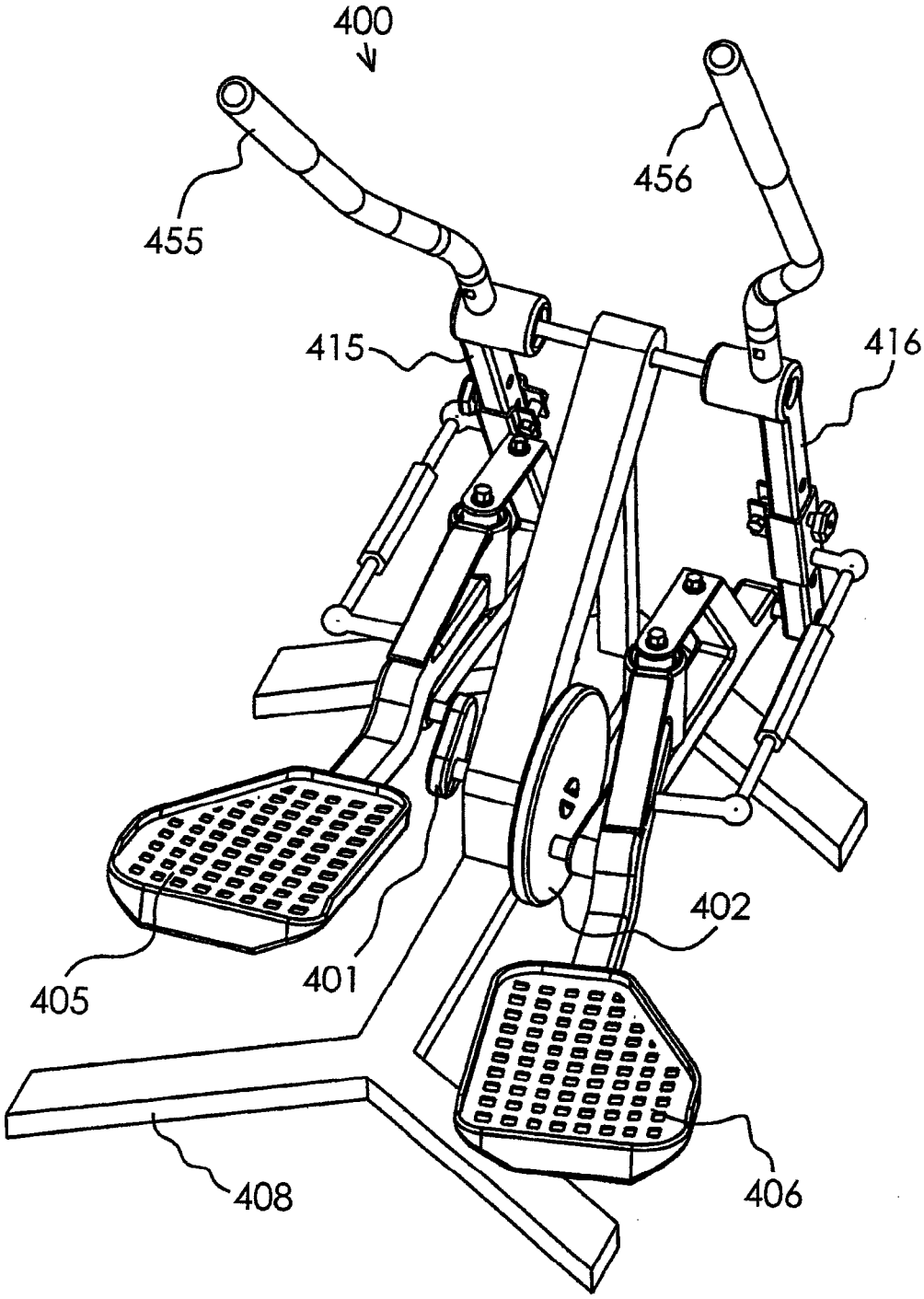
FIG. 11 is another perspective view of the exercise machine of FIG. 10.

FIGS. 8-9 show yet another example of how the present invention may be implemented on an otherwise conventional elliptical motion exercise machine. The depicted machine 300 is similar in certain respects to an exercise machine disclosed in U.S. Pat. No. 6,248,044 to Stearns et al., which is incorporated herein by reference. However, like the previous embodiments, the machine 300 generates left and right foot elliptical foot paths in respective left and right vertical planes that are skewed relative to one another.

The machine 300 includes a frame 308, and left and right cranks 301 and 302 rotatably mounted on the frame 308 for rotation about respective axes N3 and P3. Each of the axes N3 and P3 extends away from the frame 308 in a manner that defines a respective angle of approximately twenty degrees relative to a floor surface underlying the frame 308. In other words, the axes N3 and P3 define an angle of approximately one hundred and forty degrees at their point of intersection.

Left and right rocker links 335 and 336 are rotatably mounted on the frame 308 for rotation about respective rocker axes L3 and R3. The left rocker axis L3 extends parallel to the left crank axis N3, and the right rocker axis R3 extends parallel to the right crank axis P3. Left and right connector links 331 and 332 have first ends that are rotatably connected to respective rocker links 335 and 336 at a distance from respective axes L3 and R3. The connector links 331 and 332 have intermediate portions that are rotatably connected to respective cranks 301 and 302, thereby defining respective axes M3 and Q3. The left axis M3 extends parallel to the left crank axis N3, and the right axis Q3 extends parallel to the right crank axis P3.

The connector links 331 and 332 have opposite, second ends that are rotatably connected to first ends of respective left and right foot links 303 and 304. The foot links 303 and 304 have intermediate portions that are rotatably connected to respective left and right rollers 315 and 316. Each roller 315 and 316 is configured and arranged to roll in reciprocal fashion along a respective guide or race 309 or 310 on the frame 308.

Left and right foot platforms 305 and 306 are mounted on opposite, second ends of respective left and right foot links 303 and 304. The connector link assemblies and the rollers 315 and 316 cooperate to move respective foot platforms 305 and 306 through generally elliptical paths of motion. The two foot paths occupy respective planes that are perpendicular to respective axes N3 and P3 (and that define an angle of forty degrees therebetween).

The machine 300 is shown with a torque coupler 320 interconnected between the left foot supporting linkage and the right foot supporting linkage. The torque coupler 320 operates in a manner known in the art to link rotation of the cranks 301 and 302 and maintain an approximately one hundred and eighty degree phase difference between the axes N3 and P3. In the alternative, the machine 300 may be constructed without any such coupler 320, in which case the two foot platforms 305 and 306 may be moved independent of one another. Another option is to accommodate adjustments to the orientation of the guides 309 and 310 relative to the foot supporting linkages. In this regard, FIG. 9 shows a pivot location 312 associated with the guides 309 and 310, and configured to support one end of an adjustable length member. A similar arrangement may be provided on the frame to accommodate an opposite end of the adjustable length member. Such an adjustable length member may be operated by means known in the art to change the orientation of the guides 309 and 310.

Still another exercise machine constructed according to the principles of the present invention is designated as 400 in FIGS. 10-18. The depicted machine 400 is similar in certain respects to exercise machines disclosed in U.S. Pat. No. 6,196,948 to Stearns et al., which is incorporated herein by reference. However, like the previous embodiments, the machine 400 generates left and right foot elliptical foot paths in respective left and right planes that are skewed relative to one another.

Figure 12:
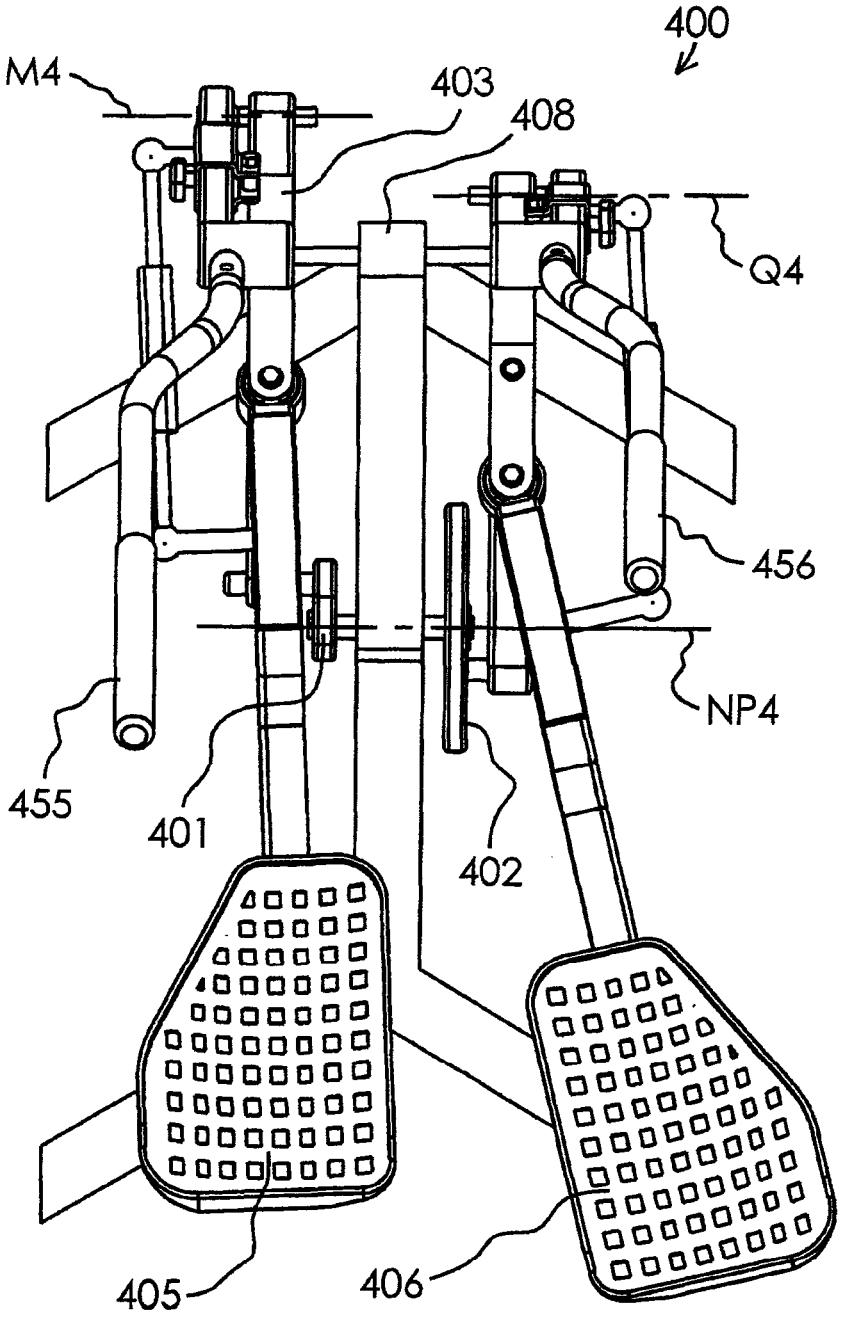
FIG. 12 is a top view of the exercise machine of FIG. 10.
Figure 13:
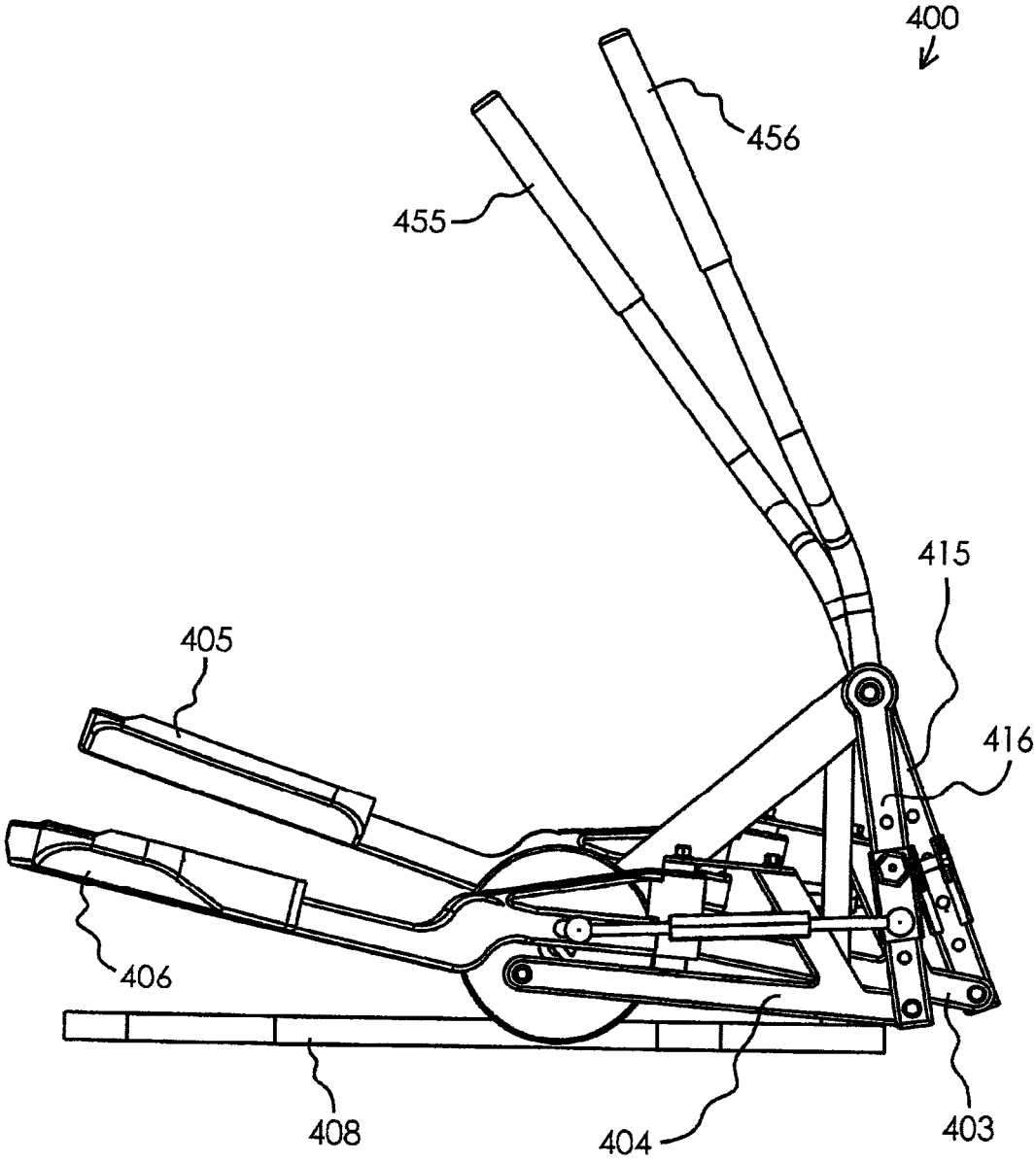
FIG. 13 is a side view of the exercise machine of FIG. 10.
Figure 14:
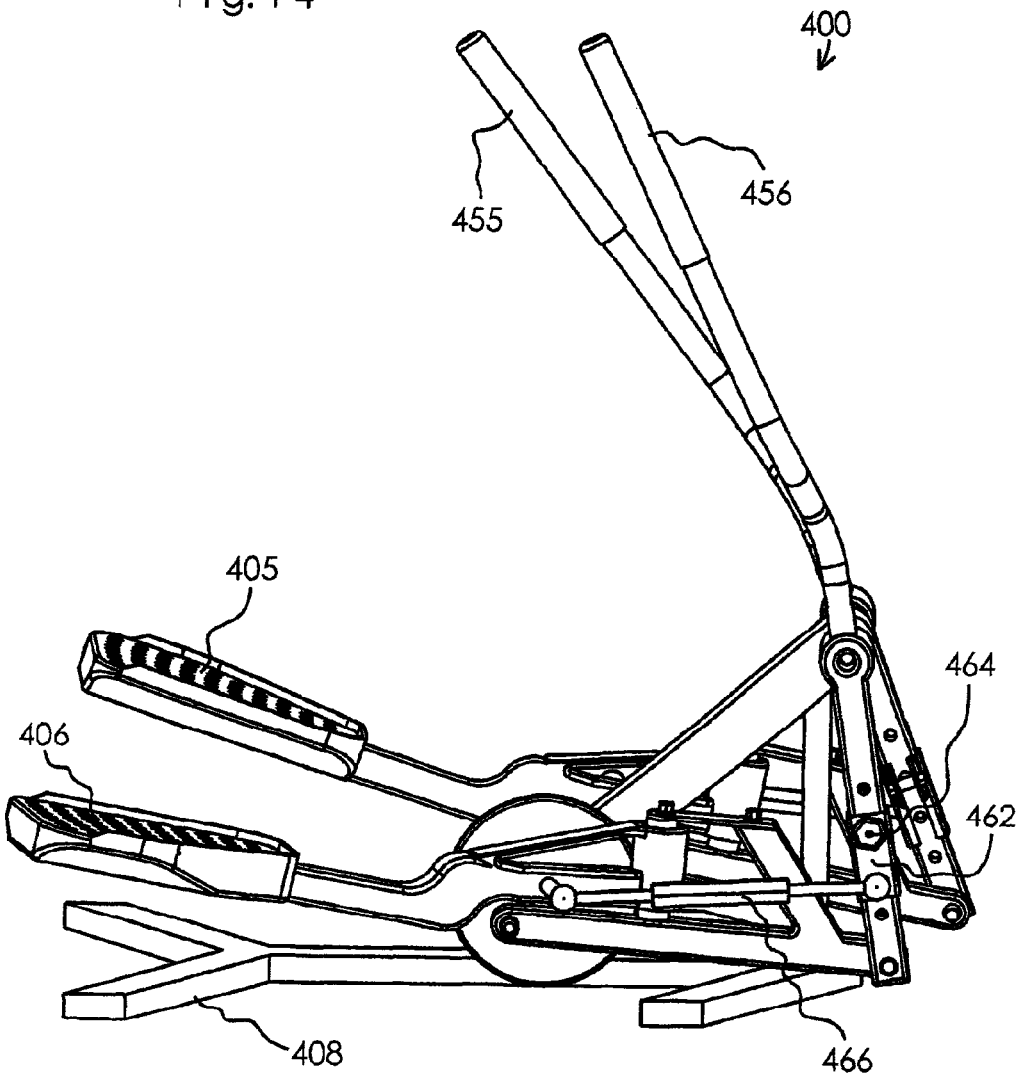
FIG. 14 is yet another perspective view of the exercise machine of FIG. 10.
Figure 15:
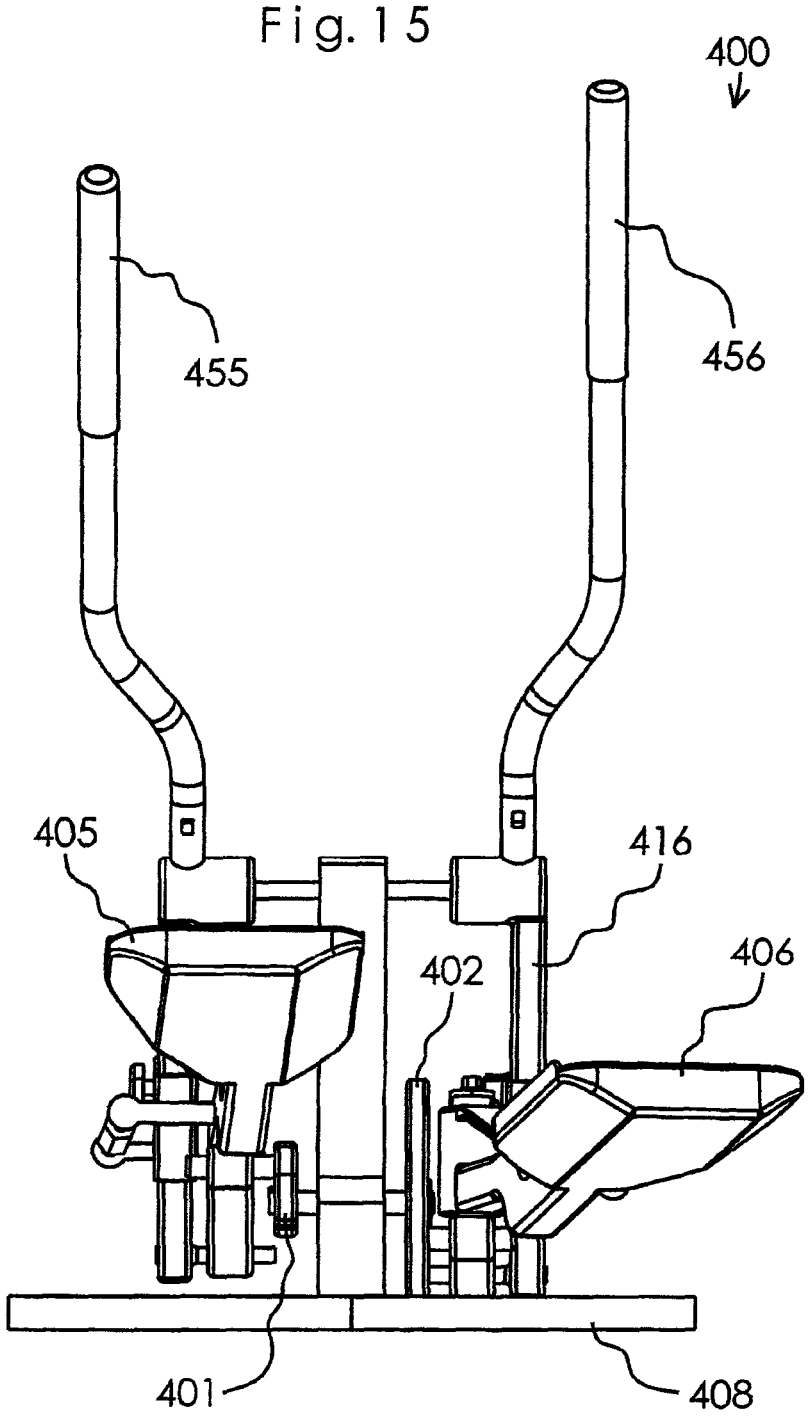
FIG. 15 is a rear view of the exercise machine of FIG. 10.
Figure 16:
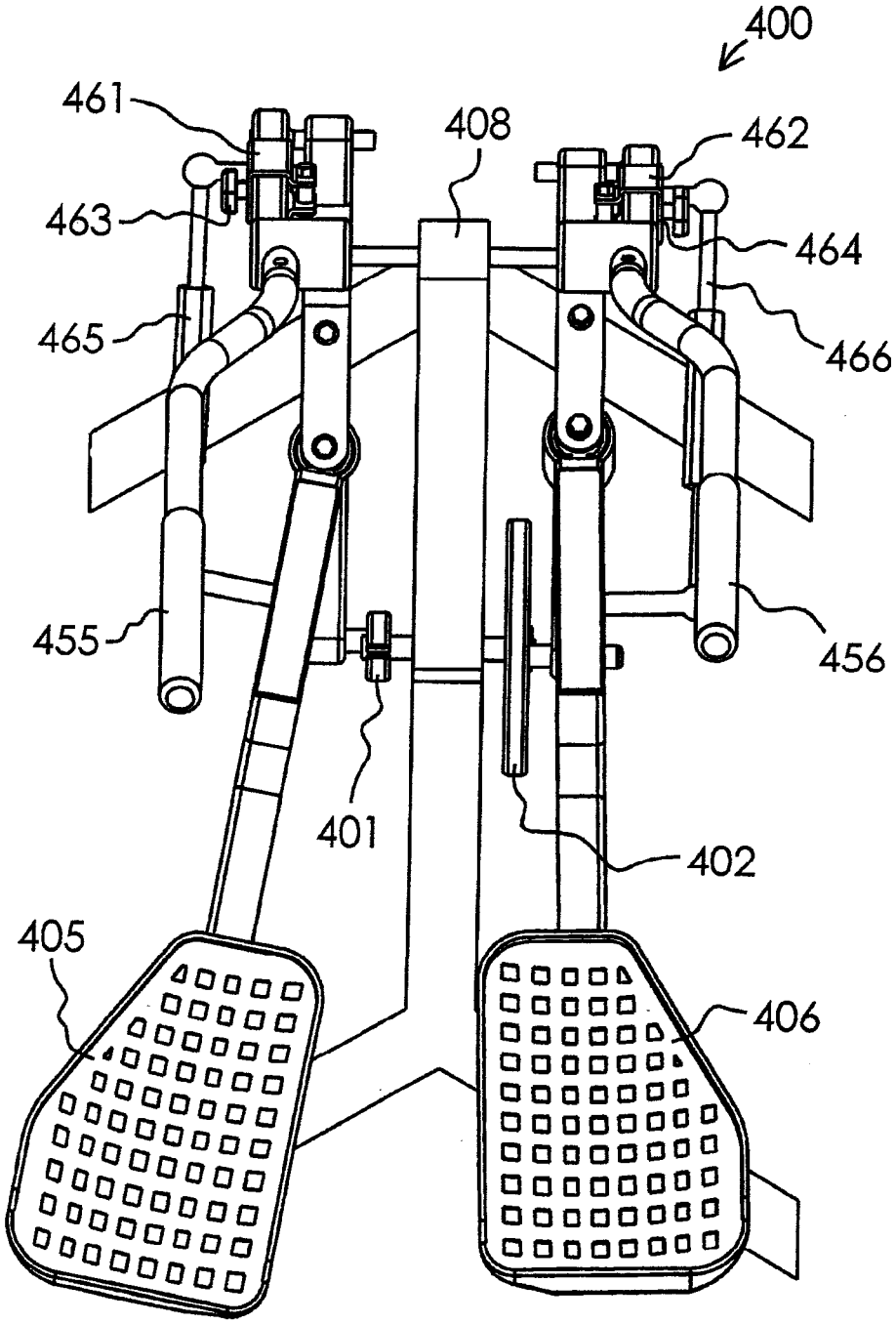
FIG. 16 is a top view of the exercise machine of FIG. 10, with the machine in a different phase of operation.
Figure 17:
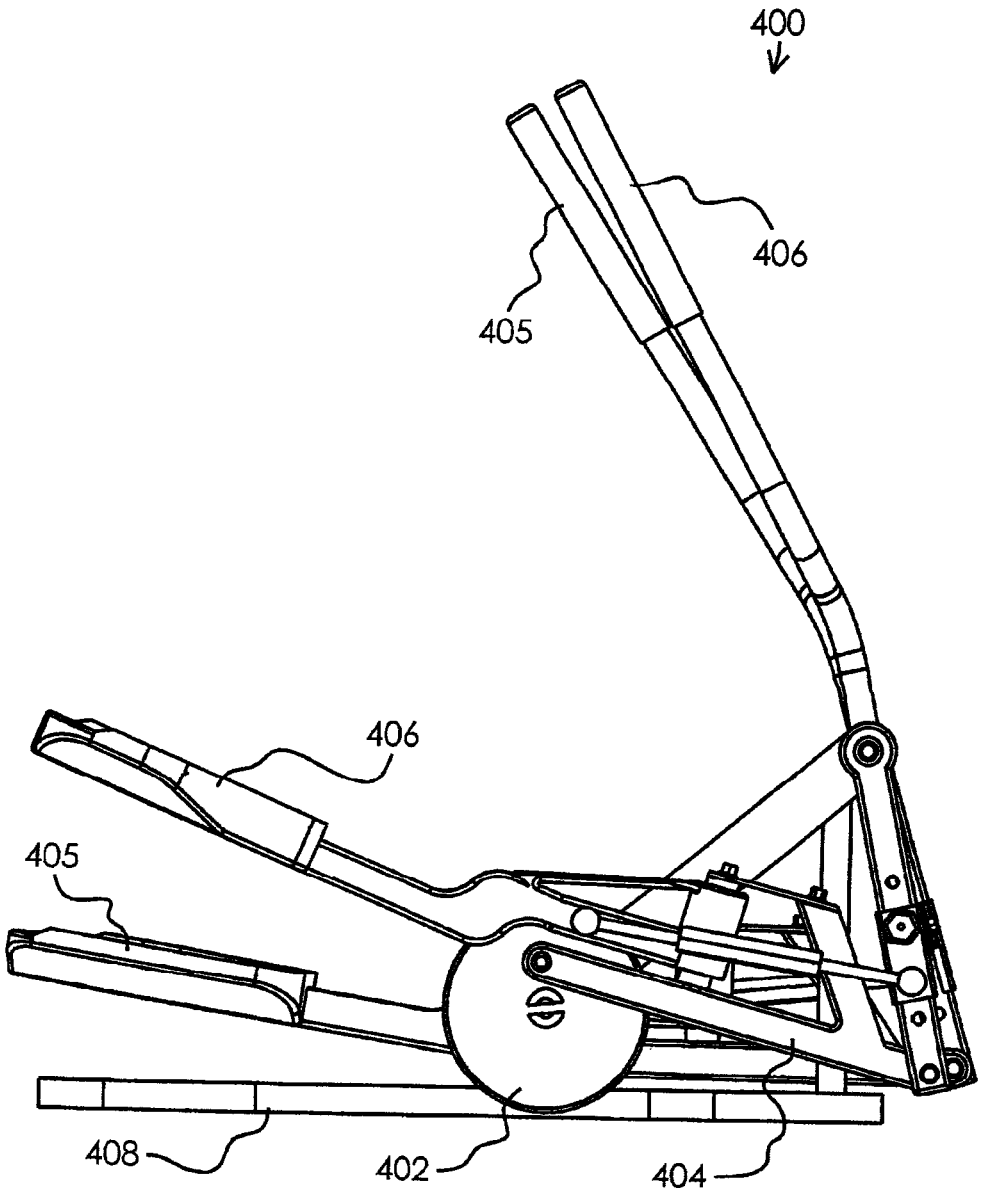
FIG. 17 is a side view of the exercise machine as shown in FIG. 16.
Figure 18:
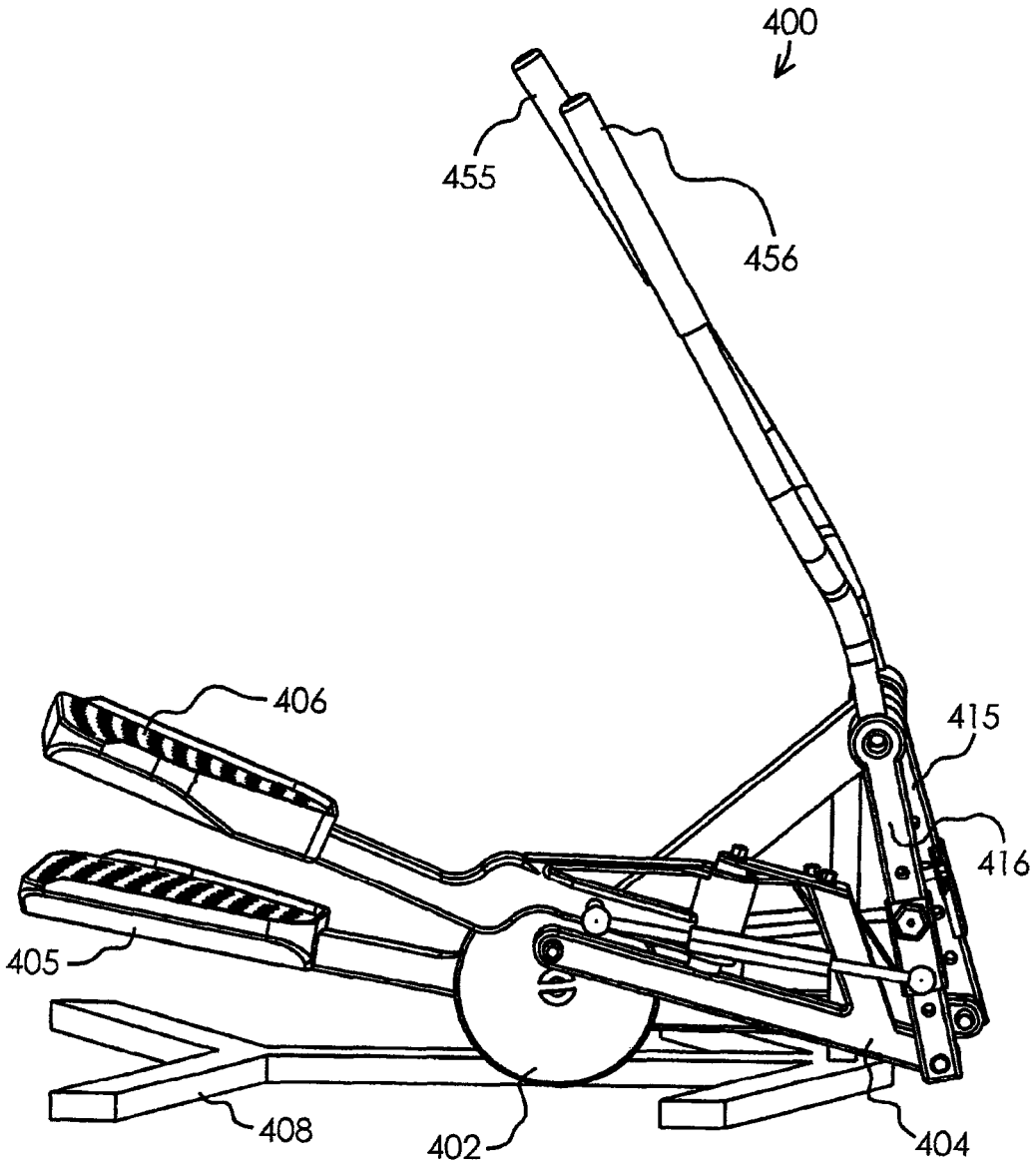
FIG. 18 is a perspective view of the exercise machine as shown in FIG. 16.

As shown in FIG. 12, the machine 400 includes a frame 408, and left and right cranks 401 and 402 rotatably mounted on the frame 408 for rotation about a common crank axis NP4. In this regard, the machine 400 is different than the previous embodiments (and more like the prior art machines).

Left and right foot links 403 and 404 have first ends that are rotatably connected to respective left and right cranks 401 and 402, thereby defining respective axes M4 and Q4, which extend parallel to the common crank axis NP4. The foot links 403 and 404 have opposite, second ends that are rotatably connected to respective left and right rocker links 415 and 416, which in turn, are rotatably mounted on the frame 408.

Left and right foot platforms 405 and 406 are mounted on intermediate portions of respective left and right foot links 403 and 404. The cranks 401 and 402 and the rocker links 415 and 416 cooperate to move respective foot platforms 405 and 406 through generally elliptical paths of motion. The foot platforms 405 and 406 are also pivotal about generally vertical axes relative to respective foot links 403 and 404.

Left and right drawbars 465 and 466 are interconnected between respective foot platforms 405 and 406 and respective rocker links 415 and 416 (via ball and socket joints). The drawbars 465 and 466 control the extent to which the foot platforms 405 and 406 pivot relative to respective foot links 403 and 404. The drawbars 465 and 466 are connected to respective sleeves 461 and 462, which in turn, are slidably mounted on respective rocker links 415 and 416. Fasteners 463 and 464 are inserted through respective sleeves 461 and 462 and into any of a series of holes in respective rocker links 415 and 416 to selectively reposition the drawbars 465 and 466 relative to respective rocker links 415 and 416. Each drawbar 465 and 466 is also selectively adjustable in length to accommodate such repositioning.

If the sleeves 461 and 462 are repositioned in a manner that aligns the relevant drawbar ball and socket joints with respective rocker link axes M4 and Q4, then the foot platforms 405 and 406 move through parallel elliptical paths. As the sleeves 461 and 462 are moved toward the pivot axis defined by the rocker links 415 and 416, the drawbars 465 and 466 cause pivotal displacement of the foot platforms 405 and 406 relative to respective foot links 403 and 404 during operation of the machine 400. The resulting foot paths lie in planes that are skewed relative to one another.

The machine 400 is shown with a crank shaft rigidly interconnected between diametrically opposed left and right cranks 401 and 402. In the alternative, the machine 400 may be constructed without such a connection, in which case the two foot platforms 405 and 406 may be moved independent of one another. Another option is to substitute spring-biased pistons for the drawbars 465 and 466, thereby making the extent of lateral foot platform displacement a function of user applied force.

Those skilled in the art will recognize that the subject present invention may be described in terms of methods with reference to the foregoing embodiments; various modifications may be made to the foregoing embodiments; and the principles of the present invention may be applied to other known embodiments of elliptical exercise machines, as well. Among other things, the crank axes may be canted at various angles, and/or directed toward any orientation. Also, the cranks may be linked to various known inertial and/or resistance units, and/or linked to handlebars that facilitate arm exercise motion, as well. In view of the foregoing, the subject invention should be limited only to the extent of the claims set forth below.

What is claimed is:

1. A stationary elliptical exercise device comprising:

(a) a frame defining a longitudinally and transversely extending mid-sagittal plane, and (b) left and right comprehensive linkages each including a plurality of links, operably supported on the frame, and including a foot supporting linkage that includes at least:

(i) a foot link operable for movement of a connection point on the foot link through a generally elliptical path within a parasagittal plane, (ii) a foot platform pivotally connected proximate a first end to the connection point on the foot link for lateral pivoting about a transverse pivot axis, and (iii) a drawbar interconnecting the foot platform to another link in the comprehensive linkage for effecting constrained coordinated pivoting of the foot platform about the transverse pivot axis as the connection point moves along the generally elliptical path.

2. The exercise device of claim 1 wherein each comprehensive linkage includes a rocker link pivotally mounted on said frame and wherein an end of said drawbar is selectively connected along said rocker link.

3. The exercise device of claim 1 wherein said drawbar comprises a spring-biased piston for effecting lateral displacement of said foot platform as a function of user applied force.

4. The exercise device of claim 2 wherein connection of said drawbar at a first position on said rocker link constrains movement of said foot platform through a generally elliptical path within the parasagittal plane.

5. The exercise device of claim 4 wherein connection of said drawbar at a second position on said rocker link constrains movement of said foot platform through a generally elliptical path in a plane skewed relative to the mid-sagittal plane.

6. The exercise device of claim 1 wherein movement of the foot platform in the left comprehensive linkage is independent from movement of the foot platform in the right comprehensive linkage.

7. The exercise device of claim 1 wherein movement of the foot platforms through respective generally elliptical paths is unsynchronized.

8. The exercise device of claim 1 wherein said drawbar is adjustable in length.

9. A stationary elliptical exercise device comprising:

(a) a frame defining a longitudinally and transversely extending mid-sagittal plane, and (b) left and right comprehensive linkages each including a plurality of links, operably supported on the frame, and including a foot supporting linkage that includes at least:

(i) a foot link operable for movement of a connection point on the foot link through a generally elliptical path within a parasagittal plane, (ii) a foot platform pivotally connected proximate a first end to the connection point on the foot link for lateral pivoting about a transverse pivot axis, (iii) a drawbar interconnecting the foot platform to another link in the comprehensive linkage for effecting constrained coordinated pivoting of the foot platform about the transverse pivot axis as the connection point moves along the generally elliptical path, and (iv) wherein the drawbar is biased toward the foot platform for effecting lateral displacement of the foot platform as a function of user applied force.

* * * * *